United States Patent [19]

Durda

[11] Patent Number: 4,954,295

[45] Date of Patent: Sep. 4, 1990

[54] PROPELLER AERATOR WITH PERIPHERAL INJECTION OF FLUID AND METHOD OF USING THE AERATOR

[75] Inventor: Joseph A. Durda, Wazatta, Minn.

[73] Assignee: Aeration Industries, Inc., Chaska, Minn.

[21] Appl. No.: 297,062

[22] Filed: Jan. 12, 1989

[51] Int. Cl.[5] ..... B01F 3/04

[52] U.S. Cl. ..... 261/16; 261/87; 261/93

[58] Field of Search ..... 261/16, 87, 93

[56] References Cited

U.S. PATENT DOCUMENTS

| | | | |
|---|---|---|---|
| 2,243,301 | 5/1941 | Weinig | 261/93 |
| 2,944,802 | 7/1960 | Daman | 261/87 |
| 3,202,281 | 8/1965 | Weston | 261/87 |
| 3,342,331 | 9/1967 | Maxwell | 261/93 |
| 3,614,072 | 10/1971 | Brodie | 261/93 |
| 3,776,531 | 12/1973 | Ebner et al. | 261/87 |
| 4,066,722 | 1/1978 | Pietruszewski et al. | 261/87 |
| 4,240,990 | 12/1980 | Inhofer et al. | 261/87 |
| 4,431,597 | 2/1984 | Cramer et al. | 261/93 |
| 4,741,870 | 5/1988 | Gross | 261/93 |

*Primary Examiner*—Tim Miles

*Attorney, Agent, or Firm*—Banner, Birch, McKie & Beckett

[57] ABSTRACT

A propeller type aeration apparatus for inducing the flow of fluids into a liquid being treated by the rotation of a propeller in the liquid includes an outer housing having a hollow interior, and opposite first and second ends. A drive shaft is supported for rotary motion about its axis within the hollow interior of the outer housing. A motor is connected to a first end of the said drive shaft for rotating the drive shaft. A propeller is attached to a second end of the drive shaft and induces a flow of the liquid in which the propeller is disposed. At least one elongate conduit is attached to an outer surface of the outer housing. One end of the conduit is located adajcent to the propeller and in the path of the flow of the liquid caused by the propeller, and a second end of the conduit is in communication with a fluid to be injected into the liquid.

14 Claims, 2 Drawing Sheets

PROPELLER AERATOR WITH PERIPHERAL INJECTION OF FLUID AND METHOD OF USING THE AERATOR

BACKGROUND OF THE INVENTION

The present invention relates broadly to an apparatus for mixing a gas with a liquid. More particularly, the present invention relates to an apparatus for aerating a liquid, such as water in a water treatment process.

TECHNICAL FIELD

Aeration apparatus are used in the treatment of water for the purpose of increasing the dissolved oxygen (DO) content of the water. A certain amount of dissolved oxygen is required for the life of fish and other aquatic organisms. Dissolved oxygen is also required to prevent the formation of offensive odors and to break down organic matter in water. The biochemical oxygen demand (BOD) is the measure of the amount of oxygen consumed in the biological processes which break down organic matter in water. A high BOD indicates that large amounts of organic waste are present and will use up large amounts of dissolved oxygen. Aeration apparatus are especially useful in increasing the amount of dissolved oxygen, and hence is useful in high-BOD situations.

Aerators utilized in waste water treatment can be broadly classified into two types, a diffused air type, and a mechanical type. A diffused air type aerator introduces air or pure oxygen into the water via submerged porous diffusers or nozzles. Mechanical type aerators agitate the water so as to promote solution of air from the atmosphere.

Mechanical type aerators are further classified as either surface aerators or turbine aerators. A surface aerator utilizes a submerged or partially submerged propeller which agitates the water vigorously to thereby entrain air in the water and cause a rapid change in the air-water interface. Turbine or propeller aerators generally utilize a rotating impeller or propeller which is disposed a certain distance below the surface of the water being treated. A draft tube is supported generally coaxial with the axis of rotation of the propeller, and is utilized to supply air to the liquid adjacent the propeller.

SUMMARY OF THE INVENTION

The present invention is directed to a propeller type aeration apparatus for inducing the flow of fluids into a liquid being treated by the rotation of a propeller in the liquid. The apparatus includes an outer housing having a hollow interior, and opposite first and second ends. A drive shaft is supported for rotary motion about its axis within the hollow interior of the outer housing. A motor is connected to a first end of the drive shaft for rotating the drive shaft. A propeller is attached to a second end of the drive shaft whereby the rotation of the drive shaft rotates the propeller and induces a flow of the liquid in which the propeller is disposed. At least one elongate conduit is attached to an outer surface of the outer housing. One end of the conduit is located adjacent to the propeller and in the path of the flow of the liquid caused by the propeller, and a second end of the conduit is in communication with a fluid to be injected into the liquid.

In one embodiment, the second end of the conduit is located in an area above the top surface of the liquid being treated and the fluid being injected through the conduit is ambient air. The second end of the conduit can alternatively be in fluid communication with a container holding a fluid other than ambient air.

In a preferred embodiment a plurality of the at least one conduit are attached to outer housing; and the second end of at least one of the conduits is located in an area above the top surface of the liquid being treated, and the fluid being injected through the last-mentioned conduit is ambient air. The second end of one or more of the other conduits can be connected in fluid communication with one or more containers holding fluid other than air.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DETAILED DESCRIPTION OF THE PREFERRED EMBODIMENT

Figures 1, 2, 3:
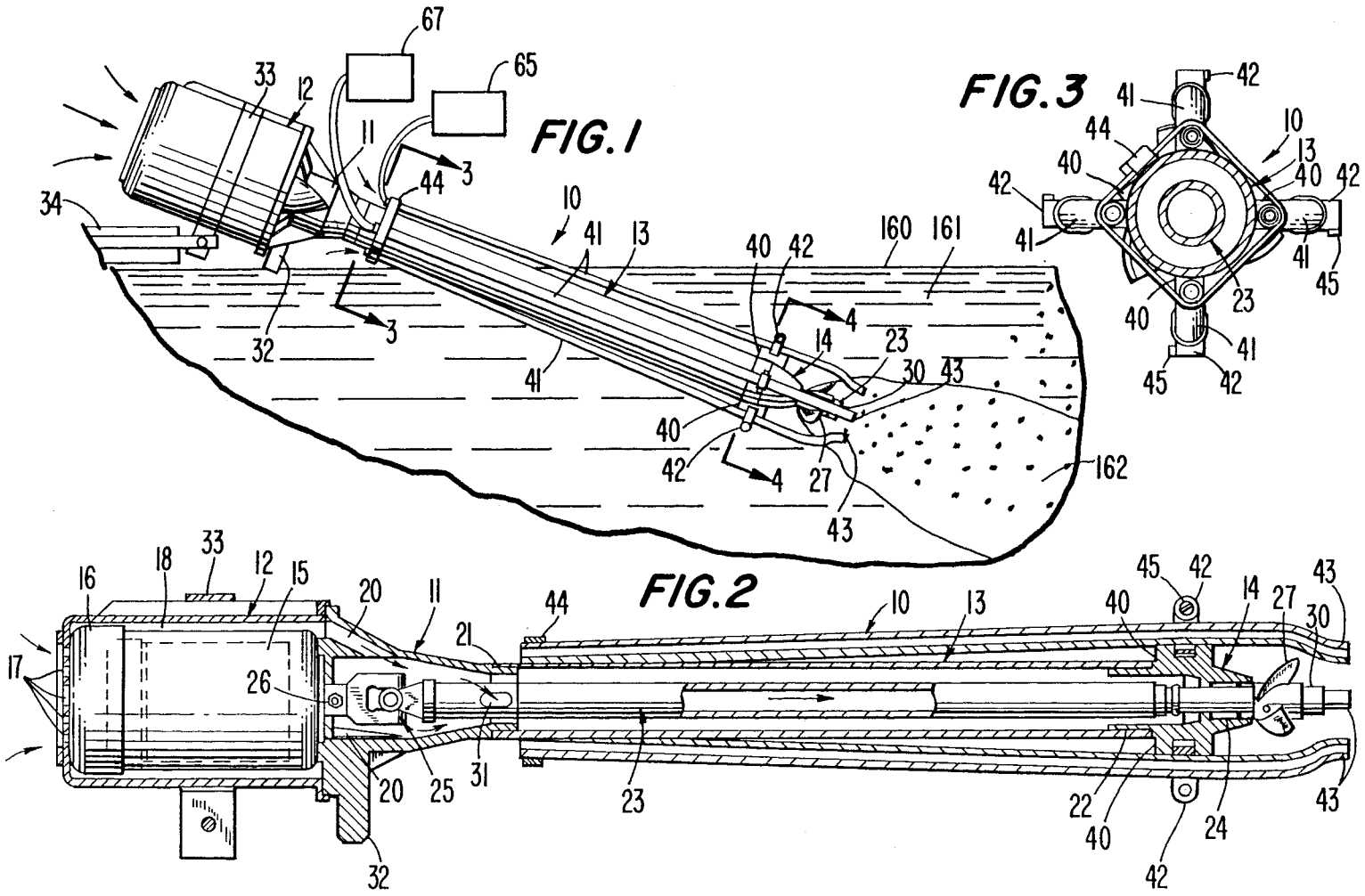
FIG. 1 is a perspective view of a first embodiment of the invention in use.
FIG. 2 is a view of the invention in longitudinal section.
FIG. 3 is a transverse sectional view along the line 3—3 of FIG. 1.

In the drawing an aerator embodying the invention is shown to comprise a housing 10 including a generally central motor adapter section 11, a motor casing 12, a drive tube casing 13, and an outboard bearing section 14.

A motor 15 is mounted on adapter section 11 by suitable means not shown, and is enclosed in casing 12 which is also secured to adapter section 11. The motor includes a fan section 16 which draws the air through apertures 17 in the end of casing 12 into a plenum 18 between the motor and the casing, and directs it over the surface of the motor and into adapter section 11 through passages 20.

Drive tube casing 13 functions as an elongate outer housing and is carried on a shoulder 21 of adapter section 11. A lower end of casing 13 receives a shoulder 22 of bearing section 14. A tubular drive shaft 23 is carried at one end in bearing 24 in section 14, and at the other end is connected by a universal joint 25 and set screw 26 to the shaft of motor 15. Outboard of section 14 shaft 23 carries propeller 27, and a diffusion tube 30 extends beyond the propeller as a continuation of the conduit defined by shaft 23. Near universal joint 25 tubular drive shaft 23 is provided with apertures 31 which enable the air from passages 20 to move down the shaft for discharge at diffusion tube 30. Adapter section 11 includes a carrying handle 32, and motor casing 12 is equipped with a mounting ring 33 by which the aerator can be supported from a suitable mount 34, with the axis of motor 15, shaft 23, propeller 27, and diffusion tube 30 sloping downwardly. An arrangement of this sort is shown in U.S. Pat. No. 4,308,221 of Daniel J. Durda; and an alternative mounting bracket and bearing arrangement for connecting the motor to the tube casing, and for supporting a lower bearing, are shown in U.S. Pat. No. 4,774,031 to Schurz. The disclosures of the '221 and '031 patents are hereby incorporated by reference.

Figure 4:
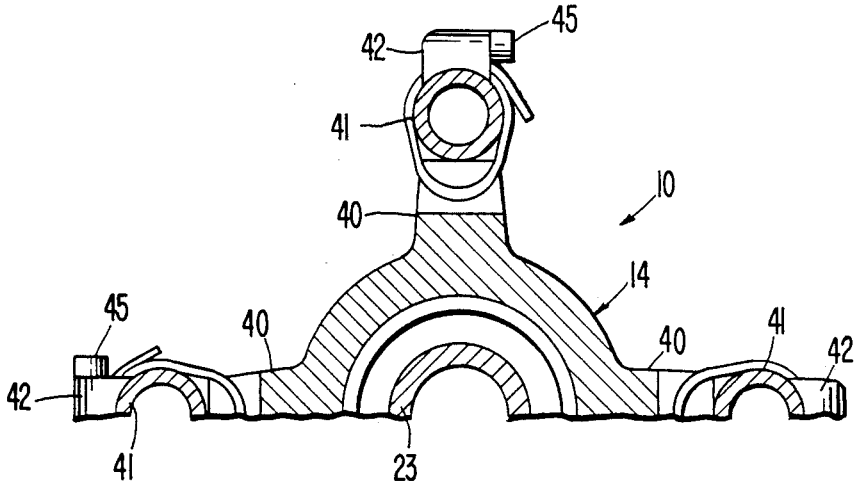
FIG. 4 is a transverse sectional view along the line 4—4 of FIG. 1.

As also shown in FIG. 4, bearing section 14 is provided with plurality of spaced radial bosses 40. A like plurality of conduits 41 extend longitudinally along the outside of casing 13, and are secured to bosses 40 by clamps 42. At their lower terminations, the conduits are provided with offsets 43 so that their open ends are adjacent propeller 27 slightly beyond the end of diffusion tube 30. At their upper terminations, the conduits are also open, and are held to the outside of casing 13 by a clamp 44. Clamps 42 and 44 may conveniently be of the type having an adjusting screw 45.

Conduits 41 are used in situations where supplemental air, in addition to the air supplied through shaft 23 and tube 30, is required for the particular treatment situation. Conduits 41 can also be used in an aerator which utilizes a solid shaft, rather than hollow shaft 23, to drive propeller 27. In such an aerator air would be supplied entirely through conduits 41.

Conduits 41 can also be used in situations where fluids other than air must be supplied to the liquid undergoing treatment. FIG. 1 diagrammatically illustrates two containers 65 and 67 as separate sources of fluids other than ambient air, connected to the upper ends of two separate conduits 41. Each container can hold a different fluid, and more sources of fluids can be connected to conduits 41 if additional types of treatment fluids are required. The fluid in containers 65 and 67 can be any type of treatment fluid and can be in a type of flowable physical form such as a gas, liquid or power.

Figure 5:
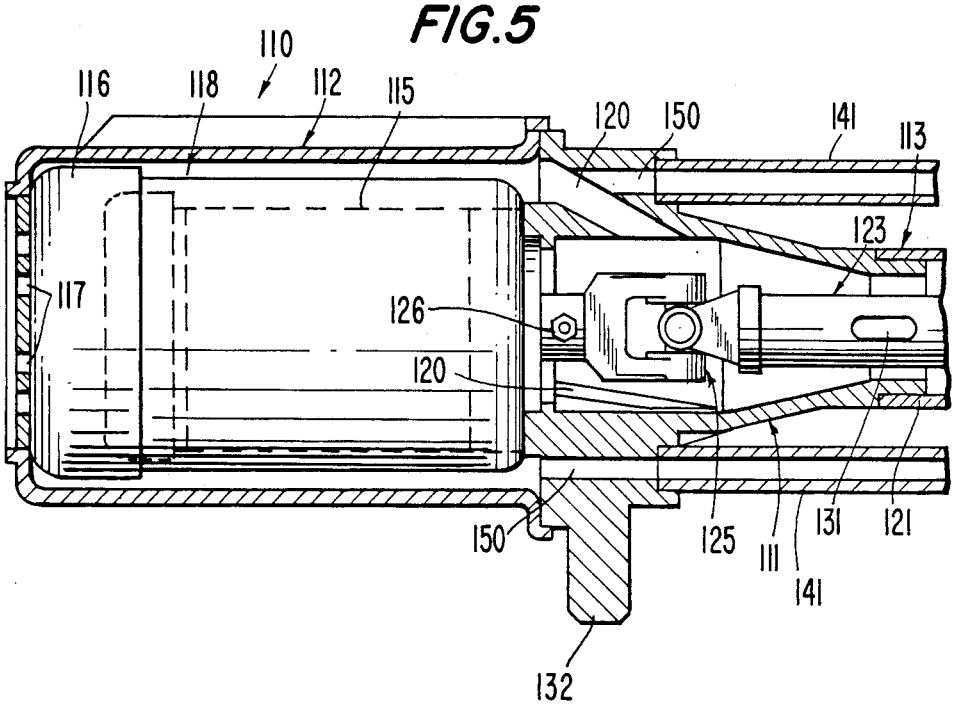
FIG. 5 is a fragmentary view generally like FIG. 2 but showing a modification of the invention.

A modification of the invention is shown in FIG. 5, where parts similar to those already named are given the same reference numerals in the series from 100 to 200. In this embodiment, conduits 141 do not terminate outside housing 110, but extend to passages 150 connecting with the plenum 118 inside casing 112. Air from fan section 116 is thus supplied to conduits 141 as well as to shaft 123.

Operation

In use my aerator is mounted on a support 34 as shown, with motor 15 and the upper ends of conduits 41 above the surface 160 of a body of liquid 161 to be aerated. When motor 15 is energized a flow of the liquid results from operation of propeller 27, as suggested at 162 in FIG. 1, the flow having a direction generally aligned with the axis of the aerator. Movement of the liquid past diffusion tube 30 entrains or aspirates air into the liquid, assisted by the positive pressure built up in the housing by operation of fan section 16. The heating of the air as it flows over motor 15 is conducive to increased solution of the oxygen in the water.

Conduits 41 also terminate at their lower ends within the directed flow of fluid, by reason of offsets 43, and the flow entrains or aspirates into its periphery further air drawn through the conduits, thus greatly increasing the amount of oxygen injected into the liquid as bubbles which dissolve as they rise to the surface. Fluid from containers 65 and 67 can simply rely on gravity and aspiration for their injection into liquid 161, or a positive pressure mechanism can be provided to assist the injection of the fluids.

For the embodiment shown in FIG. 5, the entrainment of air through conduits 141 is augmented by the positive pressure built up by the operation of fan section 116, the temperature of the air also being raised as mentioned above. This embodiment has the advantage of greater efficiency, but the embodiment first described is more amenable to disassembly for cleaning, and to removal of the conduits and clamps during intervals where less oxygen is demanded.

A vortex prevention mechanism can also be provided if it is determined that vortices tend to form during the operation of the aerator. A vortex prevention shield attached to an aerator housing is disclosed in the '221 Durda patent, and a mobile vortex shield is disclosed in U.S. Pat. No. 4,741,825 to Schiller. The disclosures of the '221 Durda patent and the '825 Schiller patent are hereby incorporated by reference.

An improved aerator in accordance with the present invention results in a more effective use of the liquid flow provided by a propeller, by enabling entrainment of air not only at the center of the flow, but also around its periphery as well, so that the area of gas-to-water contact is greatly increased. Furthermore, a readily available mechanism is provided by the external conduits for the injection of supplemental treatment fluids.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

I claim:

1. A propeller type aeration apparatus for inducing the flow of fluids into a liquid being treated by the rotation of a propeller in the liquid comprising:

an outer housing having a hollow interior, opposite first and second ends, and a longitudinal dimension extending between the two ends;

a drive shaft supported for rotary motion about its axis within the hollow interior of said outer housing;

motor means connected to a first end of said drive shaft for rotating said drive shaft;

a propeller attached to a second end of said drive shaft whereby the rotation of said drive shaft rotates said propeller and induces a flow of the liquid in which the propeller is disposed;

a first fluid outlet extending through the center of said propeller; and at least one elongate conduit attached to an outer surface of said outer housing, one end of said conduit having a second fluid outlet located adjacent to and downstream of the periphery of said propeller and in the path of the flow of the liquid caused by the propeller, and a second end of the conduit being in communication with a fluid to be injected into the fluid.

2. A propeller type aeration apparatus in accordance with claim 1 wherein said second end of said conduit is located in an area above the top surface of the liquid being treated and the fluid being injected through said conduit is ambient air.

3. A propeller type aeration apparatus in accordance with claim 1 wherein said second end of said conduit is in fluid communication with a container holding a fluid other than ambient air.

4. A propeller type aeration apparatus in accordance with claim 1 wherein a plurality of said at least one conduit are attached to said outer housing.

5. A propeller type aeration apparatus in accordance with claim 4 wherein the second end of at least one of said conduits is located in an area above the top surface of the liquid being treated and the fluid being injected through said last-mentioned conduit is ambient air.

6. A propeller type aeration apparatus in accordance with claim 5 wherein the second end of at least one other of said conduits is in fluid communication with a container holding a fluid other than ambient air.

7. A propeller type aeration apparatus in accordance with claim 1, 2, 3, 4, 5 or 6 wherein said drive shaft is hollow and includes at least one opening adjacent its upper end for admitting ambient air into its hollow interior and an open lower end adjacent said propeller.

8. A propeller type aeration apparatus in accordance with claim 1 wherein portions of said conduit adjacent both said first and second ends are secured to the outer surface of said outer housing.

9. A propeller type aeration apparatus in accordance with claim 1 including a motor casing surrounding said motor, said motor casing having at least one opening for admitting ambient air, said second end of said conduit being in fluid communication with the area between said motor and said motor casing.

10. A method of treating a liquid with at least one fluid by aspirating the at least one fluid into the liquid with a propeller type aeration device, comprising the steps of:

disposing the propeller of the aeration device in the liquid to be treated;

rotating the propeller to induce a flow of the liquid by the propeller;

inducing the flow of at least one fluid through the center of the propeller with the flow of the liquid induced by the propeller;

inducing an additional flow of the at least one fluid adjacent and downstream of the periphery of the propeller through a conduit having a fluid outlet adjacent and downstream of the periphery of the propeller so that the liquid induced by the propeller flows parallel to said fluid outlet and the additional flow is initiated in the liquid downstream of the rotating propeller.

11. A method of treating a liquid in accordance with claim 10 wherein said at least one fluid is ambient air.

12. A method of treating a liquid in accordance with claim 10 wherein the additional flow of the at least one fluid is induced at a plurality of points around the periphery of the propeller through a plurality of conduits.

13. A method of treating a liquid in accordance with claim 11 wherein said at least one fluid is ambient air.

14. A method of treating a liquid in accordance with claim 12 wherein said at least one fluid includes ambient air and at least one other fluid other than ambient air.

* * * * *